US007437097B2

(12) United States Patent
Ogawa et al.

(10) Patent No.: US 7,437,097 B2
(45) Date of Patent: Oct. 14, 2008

(54) ELECTROPHOTOGRAPHIC PHOTOSENSITIVE MEMBER WHOSE INSERT MEMBER HAS FIRST AND SECOND SURFACES OF DIFFERENT LEVELS, PROCESS CARTRIDGE, AND ELECTROPHOTOGRAPHIC APPARATUS HAVING SUCH PHOTOSENSITIVE MEMBER

(75) Inventors: Hideki Ogawa, Moriya (JP); Wataru Kitamura, Numazu (JP); Kumiko Takizawa, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 11/049,659

(22) Filed: Feb. 4, 2005

(65) Prior Publication Data

US 2005/0185986 A1 Aug. 25, 2005

(30) Foreign Application Priority Data

Feb. 20, 2004 (JP) ..... 2004-044719

(51) Int. Cl.
*G03G 15/00* (2006.01)

(52) U.S. Cl. ..... 399/159

(58) Field of Classification Search ..... 399/159
See application file for complete search history.

(56) References Cited

U.S. PATENT DOCUMENTS

| | | | | |
|---|---|---|---|---|
| 5,669,045 | A * | 9/1997 | Swain | 399/159 |
| 5,926,672 | A * | 7/1999 | Nishibata et al. | 399/111 |
| 5,991,573 | A * | 11/1999 | Nohsho et al. | 399/159 |
| 6,212,342 | B1 * | 4/2001 | Fritz | 399/91 |
| 6,408,142 | B1 * | 6/2002 | Takeuchi et al. | 399/13 |
| 6,470,158 | B2 * | 10/2002 | Fritz et al. | 399/91 |
| 6,703,174 | B2 | 3/2004 | Kitamura et al. | 430/59.5 |
| 6,757,508 | B2 * | 6/2004 | Fujishiro | 399/159 |
| 6,833,226 | B2 | 12/2004 | Takizawa et al. | 430/59.5 |
| 7,010,246 | B2 | 3/2006 | Fujishiro et al. | 399/159 |
| 2004/0042822 | A1 * | 3/2004 | Fujishiro et al. | 399/159 |
| 2004/0105696 | A1 * | 6/2004 | Tsunoda et al. | 399/91 |
| 2006/0127131 | A1 | 6/2006 | Fujishiro et al. | 399/159 |

FOREIGN PATENT DOCUMENTS

| | | | |
|---|---|---|---|
| JP | 5-35048 | A | 2/1993 |
| JP | 05035167 | A * | 2/1993 |

(Continued)

OTHER PUBLICATIONS

Dec. 16, 2006, Chinese Office Action for Chinese Application 200510008446X.

*Primary Examiner*—Quana M Grainger
(74) *Attorney, Agent, or Firm*—Fitzpatrick, Cella, Harper & Scinto

(57) ABSTRACT

An electrophotographic photosensitive member has a cylindrical support, a photosensitive layer provided on the outer-periphery side of the cylindrical support, and an insert member inserted into the cylindrical support on its inner-periphery side. The insert member has a first surface on which the former is to be fitted in the cylindrical support and a second surface which is provided at least at one end of the insert member. The first surface and the second surface have a difference in level between them. The distance between the second surface and the inner periphery of the cylindrical support is larger than distance between the first surface and the inner periphery of the cylindrical support.

10 Claims, 2 Drawing Sheets

FOREIGN PATENT DOCUMENTS

| | | | | |
|---|---|---|---|---|
| JP | 8-146637 | | | 6/1996 |
| JP | 2000-89612 | A | | 3/2000 |
| JP | 2000-98804 | A | | 4/2000 |
| JP | 2004-011854 | | | 1/2004 |
| JP | 2004053936 | A | * | 2/2004 |
| JP | 2004276290 | A | * | 10/2004 |

* cited by examiner

ELECTROPHOTOGRAPHIC PHOTOSENSITIVE MEMBER WHOSE INSERT MEMBER HAS FIRST AND SECOND SURFACES OF DIFFERENT LEVELS, PROCESS CARTRIDGE, AND ELECTROPHOTOGRAPHIC APPARATUS HAVING SUCH PHOTOSENSITIVE MEMBER

BACKGROUND OF THE INVENTION

1. Field of the Invention

This invention relates to an electrophotographic photosensitive member, and to a process cartridge and an electrophotographic apparatus which have the electrophotographic photosensitive member. More particularly, it relates to an electrophotographic photosensitive member having a cylindrical support, a photosensitive layer provided on the outer-periphery side of the cylindrical support, and an insert member inserted into the cylindrical support on its inner-periphery side, and to a process cartridge and an electrophotographic apparatus which have such an electrophotographic photosensitive member.

2. Related Background Art

In electrophotographic systems, commonly used is a system employing a process in which an electrostatic latent image is formed by charging and exposure (imagewise exposure), on the surface of an electrophotographic photosensitive member having a cylindrical support and a photosensitive layer provided on the outer-periphery side of the cylindrical support, this electrostatic latent image is developed with a toner to form a toner image, and this toner image is transferred to a transfer material, such as paper, to obtain an image-formed material (a copy or a print). Also, the surface of the electrophotographic photosensitive member, from which the toner image has been transferred, is cleaned as the occasion requires.

In electrophotographic apparatus employing this process, noises may come from various sources.

The charging of the surface of the electrophotographic photosensitive member may be one source from which a noise may be produced.

As charging assemblies, corona charging assemblies, which are non-contact charging assemblies, have conventionally been in versatile use. In recent years, however, contact charging assemblies have been put into practical use, in which the surface of an electrophotographic photosensitive member is charged by applying a voltage from an external power source to a contact charging member disposed in contact with the electrophotographic photosensitive member.

As the contact charging assemblies, from the viewpoint of charge uniformity, commonly used are assemblies in which the surface of an electrophotographic photosensitive member is charged by applying an oscillating voltage from an external power source to the contact charging member, the oscillating voltage being formed by superimposing on a DC voltage of about 1 to 2 kV an alternating voltage having a peak-to-peak voltage Vp-p of about 2 kV.

However, the contact charging member to which such an oscillating voltage is kept applied repeats its contact with, and separation from, the electrophotographic photosensitive member, and hence the electrophotographic photosensitive member may vibrate to cause a noise called charging noise.

The cleaning of the surface of the electrophotographic photosensitive member may also be another source of noise.

As electrophotographic photosensitive members are being made highly durable in recent years, a larger force of friction may act between an electrophotographic photosensitive member and a cleaning member, so that a vibration sound (noise) may occur between the electrophotographic photosensitive member and the cleaning member. This is a vibration sound which comes where the stick-slip vibration increases especially at the time the electrophotographic photosensitive member is rotated at a low speed, e.g., at the time it begins to be rotated or at the time it stops to be rotated, and the electrophotographic photosensitive member vibrates in excess.

As one of methods for preventing such noises, it is known to force an elastic material or an insert member made of resin or metal, into a cylindrical support on its inner-periphery side, of an electrophotographic photosensitive member (Japanese Patent Application Laid-open No. H05-035048, etc.).

Various methods are also known that relate to the shape of the insert member and how to fasten it (Japanese Patent Applications Laid-open No. 2000-089612, No. 2000-098804, etc.).

However, where the insert member is fastened with an adhesive to the cylindrical support on its inner-periphery side, no sufficient adhesive force is achievable unless the insert member has a proper shape, and it may come about that the insert member unfastens from the cylindrical support when the electrophotographic photosensitive member or process cartridge is in distribution in the market or when it is in use in an electrophotographic apparatus.

For example, the above Japanese Patent Application Laid-open No. 2000-089612 discloses a technique in which the insert member is tapered at its edges so that the insert member may not be caught when it is inserted into the cylindrical support on its inner-periphery side, to improve productivity.

However, the insert member having such a shape affords only small adhesion clearances between the inner-periphery side of the cylindrical support and the insert member, and hence no sufficient adhesive force has been achievable.

Especially when one composed chiefly of a resin is used as the insert member, the resin has so large a heat shrinkage in many cases that a stronger adhesive force is required.

A method is also available in which the insert member is fastened to the cylindrical support on its inner-periphery side by press fitting, without the use of any adhesive. However, if the insert member is press-fitted and fastened to such an extent that it does not start (or slip), the electrophotographic photosensitive member may have so poor a dimensional precision as to cause image density non-uniformity.

SUMMARY OF THE INVENTION

An object of the present invention is to solve the problems involved conventionally, so as to provide an electrophotographic photosensitive member having an insert member fastened by sufficient adhesive force, without causing the electrophotographic photosensitive member poor dimensional precision, and provide a process cartridge and an electrophotographic apparatus which have such an electrophotographic photosensitive member.

That is, the present invention relates to an electrophotographic photosensitive member comprising a cylindrical support, a photosensitive layer provided on the outer-periphery side of the cylindrical support, and an insert member inserted into the cylindrical support on its inner-periphery side, wherein;

the insert member has a first surface which is to be fitted in the cylindrical support and a second surface which is provided at least at one end of the insert member;

the first surface and the second surface have a difference in level between them, the distance D2 between the second surface and the inner periphery of the cylindrical support is larger than the distance D1 between the first surface and the inner periphery of the cylindrical support, the line of intersection of a cross section S2 including points on the second surface and a rotating shaft of the cylindrical support and the line of intersection of the cross section S2 and the inner periphery of the cylindrical support are substantially parallel to each other, and the insert member is fastened to the cylindrical support on its inner-periphery side, with an adhesive provided between the second surface and the inner periphery of the cylindrical support.

The present invention also relates to a process cartridge and an electrophotographic apparatus which have the above electrophotographic photosensitive member.

DESCRIPTION OF THE PREFERRED EMBODIMENTS

Figure 1A:
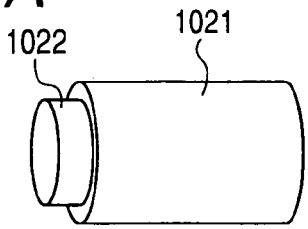
FIGS. 1A, 1B, 1C, 1D and 1E are views showing examples of the insert member used in the electrophotographic photosensitive member of the present invention.

The present invention is described below in greater detail.

FIGS. 1A, 1B, 1C, 1D and 1E are views showing examples of the insert member used in the electrophotographic photosensitive member of the present invention. In FIGS. 1A, 1B, 1C, 1D and 1E, reference numeral 1021 denotes a first surface on which the insert member is to be fitted in the cylindrical support; and reference numeral 1022 denotes a second surface which is provided at an end of the insert member. The first surface 1021 and the second surface 1022 have a difference in level between them.

Figure 1B:
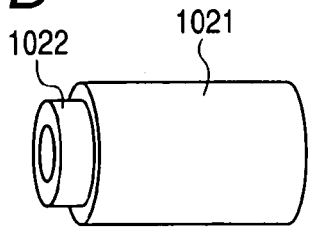
Figure 1C:
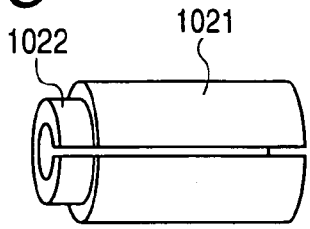
Figure 1D:
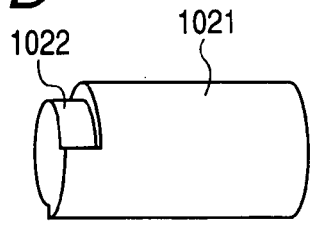
Figure 1E:
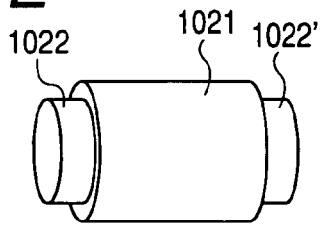

The insert member used in the electrophotographic photosensitive member of the present invention may have a shape shown in FIG. 1A, and besides may have a hollow shape as shown in FIG. 1B or 1C. Also, as shown in FIG. 1C, the first surface 1021 and the second surface 1022 may be made discontinuous by a slit. Still also, as shown in FIG. 1D, the second surface 1022 need not extend over the whole periphery. Still also, as shown in FIG. 1E, the second surface may be provided at both ends. Besides these embodiments, it may have any shape as long as it is a shape that satisfies the above prescription in the present invention. However, from the viewpoint of adhesive force, the second surface may preferably extend over 95% or more of its whole periphery, more preferably it may extend over 98% or more of its whole periphery and more preferably extend over 100% of its whole periphery.

Figure 2:
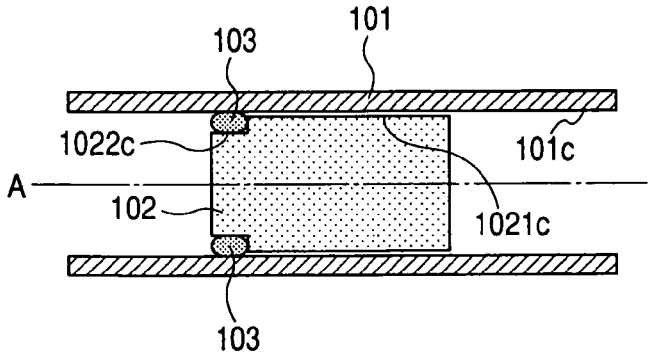
FIG. 2 is a cross-sectional view showing points on the first surface and points on the second surface of the insert member, and the rotating shaft of the cylindrical support.

FIG. 2 is a cross-sectional view (as an example) showing a cross section S including points on the first surface and points on the second surface of the insert member, and rotating shaft A of the cylindrical support. This cross section S is a cross section S1 and also a cross section S2 which are described below.

The insert member having the shape shown in FIG. 1A is given as the insert member shown in FIG. 2.

In FIG. 2, reference numeral 101 denotes the cylindrical support, reference numeral 102 denotes the insert member, and reference numeral 103 denotes an adhesive; and letter symbol A denotes the rotating shaft of the cylindrical support 101 (i.e., the rotating shaft of the electrophotographic photosensitive member). Layers such as a photosensitive layer, formed on the outer-periphery side of the cylindrical support, are not shown.

Also in FIG. 2, reference numeral 101*c* denotes the line of intersection of the cross section S and the inner periphery of the cylindrical support 101, reference characters 1021*c* denote the line of intersection of the cross section S and the first surface of the insert member 102, and reference characters 1022*c* denote the line of intersection of the cross section S and the second surface of the insert member 102.

From the viewpoint of adhesive retentivity between the second surface of the insert member and the inner periphery of the cylindrical support, the line of intersection of the cross section S2 including points on the second surface and the rotating shaft of the cylindrical support and the line of intersection of the cross section S2 and the inner periphery of the cylindrical support must substantially be parallel to each other.

In order to well bring out the effect of preventing noise by the use of the insert member, it is also preferable that the line of intersection of a cross section S1 including points on the first surface and the rotating shaft of the cylindrical support and the line of intersection of the cross section S1 and the inner periphery of the cylindrical support are substantially parallel to each other.

In the present invention, the term "substantially parallel" is meant to include a case in which an angle (acute-angled side) formed by two straight lines prolonged respectively from the two lines of intersection is preferably 15° or less, more preferably 5° or less, and still more preferably 1° or less. Incidentally, the term "substantially parallel" also includes a case in which the two straight lines are parallel to each other (truly parallel).

As mentioned above in the summary of the invention, the distance D2 between the second surface of the insert member and the inner periphery of the cylindrical support must be larger than the distance D1 between the first surface of the insert member and the inner periphery of the cylindrical support (i.e., D2−D1>0). Stated specifically, it is more preferable that the difference between the distance D2 and the distance D1 (D2−D1) is 30 μm or more. If the value of D2−D1 is too small, the effect to be brought by the present invention may be obtained with difficulty. On the other hand, it is preferable that the difference between the distance D2 and the distance D1 (D2−D1) is 150 μm or less, and more preferably 100 μm or less. If the value of D2−D1 is too large, the retentivity or adhesive force of the adhesive may decrease.

The distance D1 between the first surface of the insert member and the inner periphery of the cylindrical support is meant to be the distance between i) the line of intersection of the cross section S1 and the first surface and ii) the line of intersection of the cross section S1 and the inner periphery of the cylindrical support. Also, the distance D2 between the second surface of the insert member and the inner periphery of the cylindrical support is meant to be the distance between i) the line of intersection of the cross section S2 and the second surface and ii) the line of intersection of the cross section S2 and the inner periphery of the cylindrical support.

The difference between the distance D2 and the distance D1 (D2−D1) is also meant to be a measure of the difference in level between the first surface and the second surface.

Incidentally, where the above lines of intersection are each not linear, they are replaced by straight lines which pass both ends of the lines of intersection. Also, where the distance between the two lines of intersection is not uniform, an average value of distances is regarded as the distance between the two lines of intersection.

It is also preferable that the maximum length of the first surface of the insert member in the direction of the rotating shaft of the cylindrical support is from 50% or more to less than 100%, and particularly from 80% or more to less than 98%, with respect to the whole length of the insert member in the direction of the rotating shaft of the cylindrical support. If the maximum length of the first surface of the insert member in the direction of the rotating shaft of the cylindrical support is too small, the effect of preventing noise by the use of the insert member may be obtained with difficulty.

The insert member may be made of a material which may include, e.g., metals such as aluminum, resins such as polycarbonate resin and polyphenylene oxide resin, and rubbers such as urethane. Resins are preferred from the viewpoint of moldability.

As the adhesive used in the present invention, every kind of adhesive may be used. Fast-curing, cyanoacrylate type adhesives are preferred from the viewpoint of preventing the shifting of the insert member.

The adhesive may also preferably be applied in a peripheral form on the inner periphery of the cylindrical support. If it is applied in a dotlike form, a low adhesive force may result.

The electrophotographic photosensitive member used in the present invention is described below on its layer configuration.

As mentioned above, the electrophotographic photosensitive member of the present invention has a cylindrical support (hereinafter also "support") and a photosensitive layer provided on the outer-periphery side of the cylindrical support.

The photosensitive layer may be either of a single-layer type photosensitive layer which contains a charge-transporting material and a charge-generating material in the same layer and a multi-layer type (function-separated type) photosensitive layer which is separated into a charge generation layer containing a charge-generating material and a charge transport layer containing a charge-transporting material. From the viewpoint of electrophotographic performance, the multi-layer type photosensitive layer is preferred. The multi-layer type photosensitive layer may also include a regular-layer type photosensitive layer in which the charge generation layer and the charge transport layer are superposed in this order from the support side and a reverse-layer type photosensitive layer in which the charge transport layer and the charge generation layer are superposed in this order from the support side. From the viewpoint of electrophotographic performance, the regular-layer type photosensitive layer is preferred. Also, the charge generation layer may be constituted in a multiple layer and the charge transport layer may be constituted in a multiple layer.

As the support, it may be one having conductivity (conductive support). For example, usable are supports made of a metal such as aluminum, aluminum alloy or stainless steel. Also usable are the above supports made of a metal, or supports made of a plastic, and having layers film-formed by vacuum deposition of aluminum, aluminum alloy, indium oxide-tin oxide alloy or the like. Still also usable are supports comprising plastic or paper impregnated with conductive fine particles (e.g., carbon black, tin oxide particles, titanium oxide particles or silver particles) together with a suitable binder resin, and supports made of a plastic containing a conductive binder resin.

A conductive layer intended for the prevention of interference fringes caused by scattering of laser light or the like or for the covering of scratches of the support surface may be provided between the support and the photosensitive layer (the charge generation layer or the charge transport layer) or an intermediate layer described below. The conductive layer may be formed by coating the support with a dispersion prepared by dispersing conductive particles such as carbon black or metal particles in a binder resin. The conductive layer may preferably be in a layer thickness of from 0.1 μm to 30 μm, and more preferably from 0.5 μm to 20 μm.

An intermediate layer having the function as a barrier and the function of adhesion may also be provided between the support or the conductive layer and the photosensitive layer (the charge generation layer or the charge transport layer). The intermediate layer is formed for the purposes of, e.g., improving the adhesion of the photosensitive layer, improving coating performance, improving the injection of electric charges from the support and protecting the photosensitive layer from any electrical breakdown. The intermediate layer may be formed using a material such as casein resin, polyvinyl alcohol resin, ethyl cellulose resin, an ethylene-acrylic acid copolymer, polyamide resin, modified polyamide resin, polyurethane resin, gelatin resin or aluminum oxide.

The intermediate layer may preferably be in a layer thickness of 0.05 μm to 5 μm, and particularly more preferably from 0.3 μm to 1.5 μm.

The charge-generating material used in the electrophotographic photosensitive member of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide. Any of these charge-generating materials may be used alone or in combination of two or more.

In the case when the photosensitive layer is the multi-layer type photosensitive layer, the binder resin used to form the charge generation layer may include, e.g., polycarbonate resins, polyester resins, polyarylate resins, butyral resins, polystyrene resins, polyvinyl acetal resins, diallyl phthalate resins, acrylic resins, methacrylic resins, vinyl acetate resins, phenolic resins, silicone resins, polysulfone resins, styrene-butadiene copolymer resins, alkyd resins, epoxy resins, urea resins, and vinyl chloride-vinyl acetate copolymer resins. In particular, butyral resins and so forth are preferred. Any of these may be used alone or in the form of a mixture or copolymer of two or more types.

The charge generation layer may be formed by coating a charge generation layer coating dispersion obtained by dispersing the charge-generating material in the binder resin together with a solvent, followed by drying. As a method for dispersion, a method is available which makes use of a homogenizer, ultrasonic waves, a ball mill, a sand mill, a roll mill, a vibration mill, an attritor or a liquid impact type high-speed dispersion machine. The charge-generating material and the binder resin may preferably be in a proportion ranging from 1:0.3 to 1:4 (weight ratio).

As the solvent used for the charge generation layer coating dispersion, it may be selected taking account of the binder resin to be used and the solubility or dispersion stability of the charge-generating material. As an organic solvent, usable are alcohols, sulfoxides, ketones, ethers, esters, aliphatic halogenated hydrocarbons, aromatic compounds and so forth.

The charge generation layer may preferably be in a layer thickness of 5 μm or less, and particularly more preferably from 0.1 μm to 2 μm.

To the charge generation layer, a sensitizer, an antioxidant, an ultraviolet absorber and a plasticizer, which may be of various types, may also optionally be added.

The charge-transporting material used in the electrophotographic photosensitive member of the present invention may include, e.g., triarylamine compounds, hydrazone compounds, styryl compounds, stilbene compounds, pyrazoline compounds, oxazole compounds, thiazole compounds, and triarylmethane compounds. Any of these charge-transporting materials may be used alone or in combination of two or more.

In the case when the photosensitive layer is the multi-layer type photosensitive layer, the binder resin used to form the charge transport layer may include, e.g., acrylic resins, methacrylic resins, polyacrylamide resins, acrylonitrile resins, polyamide resins, polyvinyl butyral resins, vinyl chloride resins, vinyl acetate resins, phenoxy resins, phenolic resins, polystyrene resins, polyester resins, polycarbonate resins, polyarylate resins, polysulfone resins, polyphenylene oxide resins, epoxy resins, polyurethane resins, alkyd resins and unsaturated resins. In particular, polycarbonate resins, polyarylate resins and so forth are preferred. Any of these may be used alone or in the form of a mixture or copolymer of two or more types.

The charge transport layer may be formed by coating a charge transport layer coating solution prepared by dissolving the charge-transporting material and binder resin in a solvent, followed by drying. The charge-transporting material and the binder resin may preferably be in a proportion ranging from 5:1 to 1:5 (weight ratio), and more preferably from 3:1 to 1:3 (weight ratio).

As the solvent used in the charge transport layer coating solution, usable are ketones such as acetone and methyl ethyl ketone, esters such as methyl acetate and ethyl acetate, aromatic hydrocarbons such as toluene and xylene, ethers such as 1,4-dioxane and tetrahydrofuran, and hydrocarbons substituted with a halogen atom, such as chlorobenzene, chloroform and carbon tetrachloride.

The charge transport layer may preferably be in a layer thickness of from 5 μm to 50 μm, and particularly more preferably from 10 μm to 35 μm.

To the charge transport layer, an antioxidant, an ultraviolet absorber, a plasticizer, a filler and so forth may also optionally be added.

In the case when the photosensitive layer is the single-layer type photosensitive layer, the single-layer type photosensitive layer may be formed by coating a single-layer type photosensitive layer coating dispersion obtained by dispersing the charge-generating material and charge-transporting material in the binder resin together with the solvent, followed by drying.

A protective layer intended for the protection of the photosensitive layer may also be provided on the photosensitive layer. The protective layer may be formed by coating a protective layer coating solution obtained by dissolving a binder resins in a solvent, followed by drying. The protective layer may also be formed by coating a protective layer coating solution obtained by dissolving a binder resin monomer or oligomer in a solvent, followed by curing and/or drying. To effect the curing, light, heat or radiation (such as electron rays) may be used.

As the binder resin for the protective layer, every kind of resin described above may be used.

The protective layer may preferably be in a layer thickness of from 0.5 μm to 10 μm, and particularly preferably from 1 μm to 5 μm.

When the coating solutions for the above various layers are coated, coating methods as exemplified by dip coating, spray coating, spinner coating, roller coating, Mayer bar coating and blade coating may be used.

Figure 3:
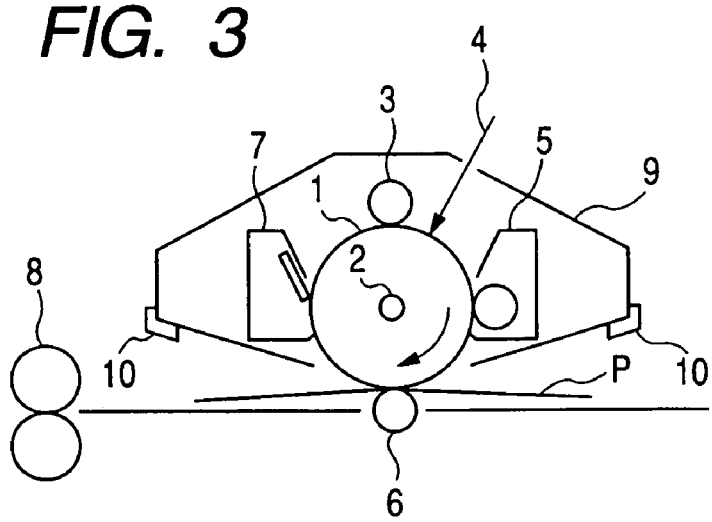
FIG. 3 is a schematic view showing an electrophotographic apparatus having a process cartridge having the electrophotographic photosensitive member of the present invention.

FIG. 3 schematically illustrates the construction of an example of an electrophotographic apparatus having a process cartridge having the electrophotographic photosensitive member.

In FIG. 3, reference numeral 1 denotes a cylindrical electrophotographic photosensitive member, which is rotatingly driven around an axis 2 in the direction of an arrow at a stated peripheral speed.

The surface of the electrophotographic photosensitive member 1 is rotatingly driven to be uniformly electrostatically charged to a positive or negative, given potential by a charging means (primary charging means, such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer contained in developing means 5, to form toner images. Then, the toner images thus formed and held on the surface of the electrophotographic photosensitive member 1 are successively transferred by applying a transfer bias from a transfer means (such as a transfer roller) 6, which are transferred onto a transfer material (such as paper) P fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1 and is led through a fixing means 8, where the toner images are fixed, and is then put out of the apparatus as an image-formed material (a print or copy).

The developer remaining on the surface of the electrophotographic photosensitive member 1 after the transfer of toner images therefrom is removed by a cleaning means (such as a cleaning blade) 7. Thus, its surface is cleaned. It is further subjected to charge elimination by pre-exposure light (not shown) emitted from a pre-exposure means (not shown), and thereafter repeatedly used for the formation of images. Incidentally, where as shown in FIG. 3 the primary charging means 3 is a contact charging means making use of a charging roller or the like, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set to be detachably mountable to the main body of an electrophotographic apparatus, such as a copying machine or a laser beam printer. In the apparatus shown in FIG. 3, the electrophotographic photosensitive member 1 and the charging means 3, the developing means 5 and the cleaning means 7 are integrally supported to form a cartridge to set up a process cartridge 9 that is detachably mountable to the main body of the electrophotographic apparatus through a guide means 10, such as rails provided in the main body of the electrophotographic apparatus.

EXAMPLES

The present invention is described below in greater detail by giving specific working examples. The present invention, however, is by no means limited to these. In the following Examples, "part(s)" refers to "part(s) by weight".

Example 1

An aluminum cylinder of 30.00 mm in outer diameter, 28.60 mm in inner diameter, 0.70 mm in wall thickness and 357.5 mm in length was used as a support (cylindrical support).

First, 10 parts of $SnO_2$-coated barium sulfate (conductive particles), 2 parts of titanium oxide (for resistance modification), 6 parts of phenol resin, 0.001 part of silicone oil (a leveling agent) and a mixed solvent of 4 parts of methanol and 16 parts of methoxypropanol were subjected to dispersion for 2 hours by means of a sand mill making use of glass beads of 1 mm in diameter, to prepare a conductive layer coating dispersion.

This conductive layer coating dispersion was dip-coated on the support, followed by curing (heat curing) at 140° C. for 30 minutes to form a conductive layer with a layer thickness of 15 μm.

Next, 3 parts of N-methoxymethylated nylon and 3 parts of copolymer nylon were dissolved in a mixed solvent of 65 parts of methanol and 30 parts of n-butanol to prepare an intermediate layer coating solution.

This intermediate layer coating solution was dip-coated on the conductive layer, followed by drying at 80° C. for 10 minutes to form an intermediate layer with a layer thickness of 0.5 μm.

Next, 4 parts of an azo pigment (charge-generating material) having a structure represented by the following formula:

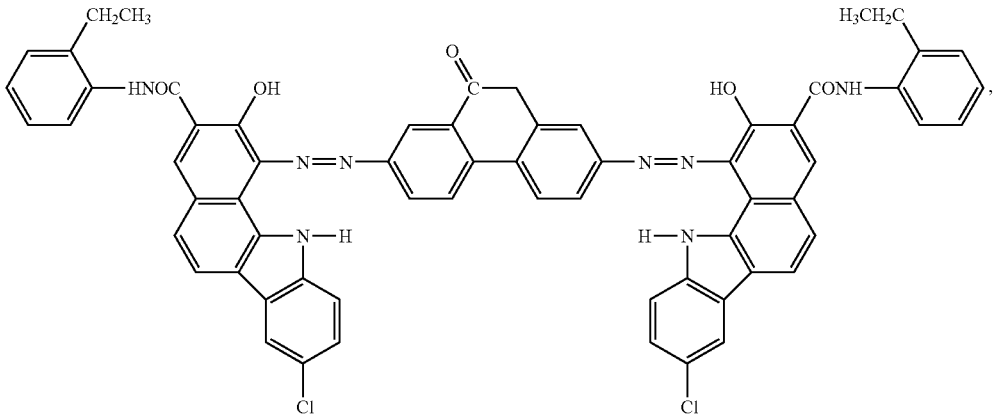

2 parts of polyvinyl butyral resin (trade name: S-LEC BLS, available from Sekisui Chemical Co., Ltd.) and 35 parts of cyclohexanone were subjected to dispersion for 12 hours by means of a sand mill making use of glass beads of 1 mm in diameter, and then 60 parts of methyl ethyl ketone was added to prepare a charge generation layer coating dispersion.

This charge generation layer coating dispersion was dip-coated on the intermediate layer, followed by drying at 80° C. for 10 minutes to form a charge generation layer with a layer thickness of 0.3 μm.

Next, 7 parts of an amine compound having a structure represented by the following formula:

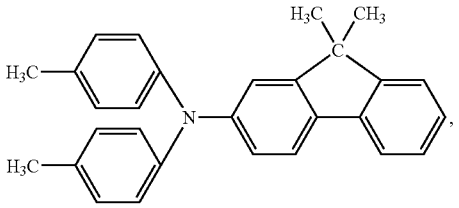

1 part of an amine compound having a structure represented by the following formula:

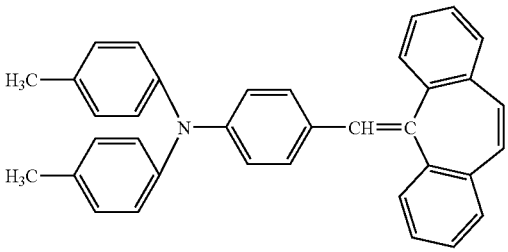

and 10 parts of polycarbonate resin (trade name: IUPILON Z-200; available from Mitsubishi Gas Chemical Company, Inc.) were dissolved in 80 parts of chlorobenzene to prepare a charge transport layer coating solution.

This charge transport layer coating solution was dip-coated on the charge generation layer, followed by drying at 120° C. for 1 hour to form a charge transport layer with a layer thickness of 30 μm.

Next, the support was coated with 0.1 g of a cyanoacrylate type instantaneous adhesive on its inner-periphery side and at its region up to 50 mm from an end of the cylindrical support. Thereafter, an insert member made of polyphenylene oxide resin, having the shape (outline) shown in FIG. 1A was inserted into the cylindrical support with the former's second-surface ahead and up to the middle portion of the cylindrical support. Having been inserted in this way, the adhesive was led into the part between the second surface of the insert member and the inner periphery of the cylindrical support. After the insert member was inserted, the adhesive was dried at 23° C. for 48 hours.

Thus, an electrophotographic photosensitive member was produced which had the cylindrical support, the photosensitive layer provided on the outer-periphery side of the cylindrical support, and the insert member inserted into the cylindrical support on its inner-periphery side.

Here, the insert member used in Example 1 had dimensions as shown below.

Whole length in the direction of the rotating shaft of the cylindrical support: 100 mm.

Length of the first surface in the direction of the rotating shaft of the cylindrical support: 90 mm.

Outer diameter at the part of the first surface: 28.46 mm.

Length of the second surface in the direction of the rotating shaft of the cylindrical support: 10 mm.

Outer diameter at the part of the second surface: 28.32 mm.

D2−D1: 0.07 mm.

Line of intersection of the cross section S1 and the first surface and the line of intersection of the cross section S1 and the inner periphery of the cylindrical support: Parallel to each other.

Line of intersection of the cross section S2 and the second surface and the line of intersection of the cross section S2 and the inner periphery of the cylindrical support: Parallel to each other.

Evaluation of Reproduced Images:

The electrophotographic photosensitive member produced was set in a copying machine iR3300 (having an AC/DC contact charging assembly and a cleaning blade), manufactured by CANON, INC., and images were reproduced in an environment of 23° C./50% RH, using A4-size plain paper to evaluate reproduced images. As the result, any image defects, such as density non-uniformity, did not appear.

Leaving Test:

Next, the same electrophotographic photosensitive member as the above was left for 100 hours in an environment of 40° C./95% RH, and then left for 100 hours in an environment of 5° C./10% RH. Thereafter, the state of the insert member being fastened was examined to ascertain that the insert member was seen not to have unfastened.

Example 2

An electrophotographic photosensitive member was produced in the same manner as in Example 1 except that, in Example 1, the insert member was changed for an insert member made of polyphenylene oxide resin, having the shape (outline) shown in FIG. 1B. An evaluation was made in the same way. Any image defects, such as density non-uniformity, did not appear, and the insert member was seen not to have unfastened.

Here, the insert member used in Example 2 had dimensions as shown below.

Whole length in the direction of the rotating shaft of the cylindrical support: 100 mm.

Length of the first surface in the direction of the rotating shaft of the cylindrical support: 90 mm.

Outer diameter at the part of the first surface: 28.46 mm.

Length of the second surface in the direction of the rotating shaft of the cylindrical support: 10 mm.

Outer diameter at the part of the second surface: 28.32 mm.

D2−D1: 0.07 mm.

Inner diameter: 15 mm.

Line of intersection of the cross section S1 and the first surface and the line of intersection of the cross section S1 and the inner periphery of the cylindrical support: Parallel to each other.

Line of intersection of the cross section S2 and the second surface and the line of intersection of the cross section S2 and the inner periphery of the cylindrical support: Parallel to each other.

Example 3

An electrophotographic photosensitive member was produced in the same manner as in Example 1 except that, in Example 1, the insert member was changed for an insert member made of polyphenylene oxide resin, having the shape (outline) shown in FIG. 1C. An evaluation was made in the same way. Any image defects such as density non-uniformity did not appear, and the insert member was seen not to have unfastened.

Here, the insert member used in Example 3 had dimensions as shown below.

Whole length in the direction of the rotating shaft of the cylindrical support: 100 mm.

Length of the first surface in the direction of the rotating shaft of the cylindrical support: 90 mm.

Outer diameter at the part of the first surface: 28.80 mm.

Length of the second surface in the direction of the rotating shaft of the cylindrical support: 10 mm.

Outer diameter at the part of the second surface: 28.66 mm.

D2−D1: 0.07 mm.

Inner diameter: 15 mm.

Slit width: 2 mm.

Line of intersection of the cross section S1 and the first surface and the line of intersection of the cross section S1 and the inner periphery of the cylindrical support: Parallel to each other.

Line of intersection of the cross section S2 and the second surface and the line of intersection of the cross section S2 and the inner periphery of the cylindrical support: Parallel to each other.

Example 4

An electrophotographic photosensitive member was produced in the same manner as in Example 1 except that, in Example 1, the insert member was changed for an insert member made of polyphenylene oxide resin, having the shape (outline) shown in FIG. 1E. An evaluation was made in the same way. Any image defects such as density non-uniformity did not appear, and the insert member was seen not to have unfastened.

Here, the insert member used in Example 4 had dimensions as shown below.

Whole length in the direction of the rotating shaft of the cylindrical support: 100 mm.

Length of the first surface in the direction of the rotating shaft of the cylindrical support: 80 mm.

Outer diameter at the part of the first surface: 28.46 mm.

Lengths of two second surfaces in the direction of the rotating shaft of the cylindrical support: 10 mm each.

Outer diameters at the part of two second surfaces: 28.32 mm each.

D2–D1: 0.07 mm each.

Line of intersection of the cross section S1 and the first surface and the line of intersection of the cross section S1 and the inner periphery of the cylindrical support: Parallel to each other.

Line of intersection of the cross section S2 and the second surface and the line of intersection of the cross section S2 and the inner periphery of the cylindrical support: Parallel to each other.

Example 5

An electrophotographic photosensitive member was produced in the same manner as in Example 1 except that, in Example 1, the insert member was changed for an insert member whose "D2–D1" was 0.15 mm. An evaluation was made in the same way. Any image defects such as density non-uniformity did not appear, and the insert member was seen not to have unfastened.

Example 6

An electrophotographic photosensitive member was produced in the same manner as in Example 1 except that, in Example 1, the insert member was changed for an insert member whose "Length of the first surface in the direction of the rotating shaft of the cylindrical support" was 50 mm and "Length of the second surface in the direction of the rotating shaft of the cylindrical support" was 50 mm. An evaluation was made in the same way. Any image defects, such as density non-uniformity, did not appear, and the insert member was seen not to have unfastened.

Example 7

An electrophotographic photosensitive member was produced in the same manner as in Example 1 except that, in Example 1, the insert member was changed for an insert member made of polycarbonate resin (having the same dimensions). An evaluation was made in the same way. Any image defects, such as density non-uniformity, did not appear, and the insert member was seen not to have unfastened.

Example 8

An electrophotographic photosensitive member was produced in the same manner as in Example 1 except that, in Example 1, the insert member was changed for an insert member made of aluminum (having the same dimensions). An evaluation was made in the same way. Any image defects, such as density non-uniformity, did not appear, and the insert member was seen not to have unfastened.

Example 9

An electrophotographic photosensitive member was produced in the same manner as in Example 1 except that, in Example 1, the insert member was changed for an insert member made of urethane rubber (having the same dimensions). An evaluation was made in the same way. Any image defects, such as density non-uniformity, did not appear, and the insert member was seen not to have unfastened.

Comparative Example 1

Figure 4A:
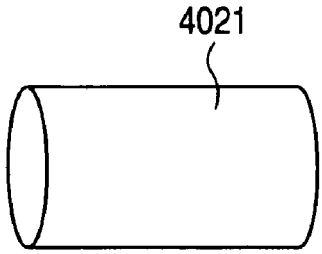
FIGS. 4A, 4B, 4C and 4D are views showing insert members used in Comparative Examples.

An electrophotographic photosensitive member was produced in the same manner as in Example 1 except that, in Example 1, the insert member was changed for an insert member made of polyphenylene oxide resin, having a shape (outline) shown in FIG. 4A. An evaluation was made in the same way. Any image defects, such as density non-uniformity, did not appear, but after the above leaving test the insert member was seen to have unfastened.

Here, the insert member used in Comparative Example 1 had dimensions as shown below.

Whole length in the direction of the rotating shaft of the cylindrical support: 100 mm.

Length in the direction of the rotating shaft of the cylindrical support, of a surface 4021 on which the insert member was to be fitted in the cylindrical support: 100 mm.

Outer diameter at the part of the surface 4021 on which the insert member was to be fitted in the cylindrical support: 28.46 mm.

Inner diameter: 15 mm.

No difference in level.

Comparative Example 2

Figure 4B:
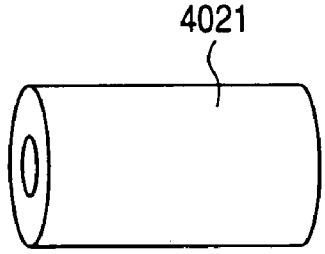

An electrophotographic photosensitive member was produced in the same manner as in Example 1 except that, in Example 1, the insert member was changed for an insert member made of polyphenylene oxide resin, having a shape (outline) shown in FIG. 4B. An evaluation was made in the same way. Any image defects, such as density non-uniformity, did not appear, but after the above leaving test the insert member was seen to have unfastened.

Here, the insert member used in Comparative Example 2 had dimensions as shown below.

Whole length in the direction of the rotating shaft of the cylindrical support: 100 mm.

Length in the direction of the rotating shaft of the cylindrical support, of a surface 4021 on which the insert member was to be fitted in the cylindrical support: 100 mm.

Outer diameter at the part of the surface 4021 on which the insert member was to be fitted in the cylindrical support: 28.46 mm.

Inner diameter: 15 mm.

No difference in level.

Comparative Example 3

Figure 4C:
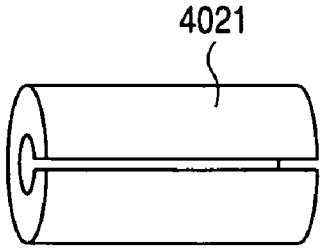

An electrophotographic photosensitive member was produced in the same manner as in Example 1 except that, in Example 1, the insert member was changed for an insert member made of polyphenylene oxide resin, having a shape (outline) shown in FIG. 4C. An evaluation was made in the same way. Any image defects, such as density non-uniformity, did not appear, but after the above leaving test the insert member was seen to have unfastened.

Here, the insert member used in Comparative Example 3 had dimensions as shown below.

Whole length in the direction of the rotating shaft of the cylindrical support: 100 mm.

Length in the direction of the rotating shaft of the cylindrical support, of a surface 4021 on which the insert member was to be fitted in the cylindrical support: 100 mm.

Outer diameter at the part of the surface 4021 on which the insert member was to be fitted in the cylindrical support: 28.80 mm.

Inner diameter: 15 mm.

Slit width: 2 mm.

No difference in level.

Comparative Example 4

An electrophotographic photosensitive member was produced in the same manner as in Comparative Example 13 except that, in Comparative Example 13, the insert member was changed for an insert member whose "Outer diameter at the part of the surface 4021 on which the insert member was to be fitted in the cylindrical support" was 29.00 mm and that the insert member was not fastened with the adhesive. An evaluation was made in the same way. After the above leaving test, the insert member was seen not to have unfasten. However, in the evaluation of reproduced images, density non-uniformity was seen to have appeared.

Comparative Example 5

Figure 4D:
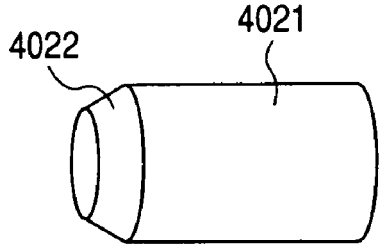

An electrophotographic photosensitive member was produced in the same manner as in Example 1 except that, in Example 1, the insert member was changed for an insert member made of polyphenylene oxide resin, having a shape (outline) shown in FIG. 4D. An evaluation was made in the same way. Any image defects, such as density non-uniformity, did not appear, but after the above leaving test the insert member was seen to have unfastened.

Here, the insert member used in Comparative Example 5 had dimensions as shown below.

Whole length in the direction of the rotating shaft of the cylindrical support: 100 mm.

Length in the direction of the rotating shaft of the cylindrical support, of a surface 4021 on which the insert member was to be fitted in the cylindrical support: 90 mm.

Outer diameter at the part of the surface 4021 on which the insert member was to be fitted in the cylindrical support: 28.46 mm.

Taper angle of a tapered surface 4022: 45°.

No difference in level.

As described hereinbefore, the present invention can provide an electrophotographic photosensitive member having an insert member fastened by sufficient adhesive force, without causing the electrophotographic photosensitive member poor dimensional precision, and provide a process cartridge and an electrophotographic apparatus which have such an electrophotographic photosensitive member.

This application claims priority from Japanese Patent Application No. 2004-044719 filed Feb. 20, 2004, which is hereby incorporated by reference herein.

What is claimed is:

1. An electrophotographic photosensitive member comprising:

a cylindrical support;

a photosensitive layer provided on the outer-periphery side of the cylindrical support; and an insert member inserted into the cylindrical support on its inner-periphery side, wherein:

the insert member has a first surface on which the insert is to be fitted in the cylindrical support and a second surface which is provided at least at one endmost portion of the insert member;

the first surface and the second surface have a difference in level between them;

the distance D2 between the second surface and the inner periphery of the cylindrical support is larger than distance D1 between the first surface and the inner periphery of the cylindrical support;

the line of intersection of a cross section S2 including points on the second surface and a rotating shaft of the cylindrical support and the line of intersection of the cross section S2 and the inner periphery of the cylindrical support are substantially parallel to each other;

the insert member is fastened to the cylindrical support on its inner periphery side, with an adhesive provided between the second surface and the inner periphery of the cylindrical support;

the difference D2−D1 between the distance D2, between the second surface and the inner periphery of the cylindrical support, and the distance D1, between the first surface and the inner periphery of the cylindrical support, is in the range of from 30 μm to 150 μm;

wherein a maximum length of the first surface of the insert member in the direction of the rotating shaft of the cylindrical support is from 80% to 98% with respect to the whole length of the insert member in the direction of the rotating shaft of the cylindrical support; and wherein the second surface extends over 95% or more of its whole periphery.

2. The electrophotographic photosensitive member according to claim 1, wherein the line of intersection of a cross section S1 including points on the first surface and the rotating shaft of the cylindrical support and the line of intersection of the cross section S1 and the inner periphery of the cylindrical support are substantially parallel to each other.

3. A process cartridge comprising:

an electrophotographic photosensitive member having a cylindrical support, a photosensitive layer provided on the outer-periphery side of the cylindrical support, and an insert member inserted into the cylindrical support on its inner-periphery side; and at least one device selected from the group consisting of a charging device, a developing device, a transfer device and a cleaning device, the process cartridge being detachably mountable to the main body of the electrophotographic apparatus;

wherein:

the insert member has a first surface on which the insert is to be fitted in the cylindrical support and a second surface which is provided at least at one endmost portion of the insert member;

the first surface and the second surface have a difference in level between them;

the distance D2 between the second surface and the inner periphery of the cylindrical support is larger than distance D1 between the first surface and the inner periphery of the cylindrical support;

the line of intersection of a cross section S2 including points on the second surface and a rotating shaft of the cylindrical support and the line of intersection of the cross section S2 and the inner periphery of the cylindrical support are substantially parallel to each other;

the insert member is fastened to the cylindrical support on its inner periphery side, with an adhesive provided between the second surface and the inner periphery of the cylindrical support;

the difference D2−D1 between the distance D2, between the second surface and the inner periphery of the cylindrical support, and the distance D1, between the first surface and the inner periphery of the cylindrical support, is in the range of from 30 μm to 150 μm;

wherein a maximum length of the first surface of the insert member in the direction of the rotating shaft of the cylindrical support is from 80% to 98% with respect to the whole length of the insert member in the direction of the rotating shaft of the cylindrical support; and wherein the second surface extends over 95% or more of its whole periphery.

4. An electrophotographic apparatus comprising:

an electrophotographic photosensitive member having a cylindrical support, a photosensitive layer provided on the outer-periphery side of the cylindrical support, and an insert member inserted into the cylindrical support on its inner-periphery side;

a charging device;

an exposure device;

a developing device; and a transfer device;

wherein:

the insert member has a first surface on which the insert is to be fitted in the cylindrical support and a second surface which is provided at least at one endmost portion of the insert member;

the first surface and the second surface have a difference in level between them;

the distance D2 between the second surface and the inner periphery of the cylindrical support is larger than distance D1 between the first surface and the inner periphery of the cylindrical support;

the line of intersection of a cross section S2 including points on the second surface and a rotating shaft of the cylindrical support and the line of intersection of the cross section S2 and the inner periphery of the cylindrical support are substantially parallel to each other;

the insert member is fastened to the cylindrical support on its inner periphery side, with an adhesive provided between the second surface and the inner periphery of the cylindrical support;

the difference D2−D1 between the distance D2, between the second surface and the inner periphery of the cylindrical support, and the distance D1, between the first surface and the inner periphery of the cylindrical support, is in the range of from 30 μm to 150 μm;

wherein a maximum length of the first surface of the insert member in the direction of the rotating shaft of the cylindrical support is from 80% to 98% with respect to the whole length of the insert member in the direction of the rotating shaft of the cylindrical support; and wherein the second surface extends over 95% or more of its whole periphery.

5. An electrophotographic photosensitive member comprising:

a cylindrical support;

a photosensitive layer provided on the outer periphery side of the cylindrical support; and an insert member inserted into the cylindrical support on its inner periphery side, wherein:

the insert member has a first surface on which the insert is to be fitted in the cylindrical support and a second surface which is provided at least at one endmost portion of the insert member;

the first surface and the second surface have a difference in level between them;

the distance D2 between the second surface and the inner periphery of the cylindrical support is larger than distance D1 between the first surface and the inner periphery of the cylindrical support;

the line of intersection of a cross section S2 including points on the second surface and a rotating shaft of the cylindrical support and the line of intersection of the cross section S2 and the inner periphery of the cylindrical support are substantially parallel to each other;

the insert member is fastened to the cylindrical support on its inner periphery side, with an adhesive provided between the second surface and the inner periphery of the cylindrical support;

the difference D2 D1 between the distance D2, between the second surface and the inner periphery of the cylindrical support, and the distance D1, between the first surface and the inner periphery of the cylindrical support, is in the range of from 30 μm to 150 μm;

wherein a maximum length of the first surface of the insert member in the direction of the rotating shaft of the cylindrical support is from 80% to 98% with respect to the whole length of the insert member in the direction of the rotating shaft of the cylindrical support;

wherein the second surface extends over 95% or more of its whole periphery; and the adhesive is a cyanoacrylate-type adhesive.

6. An electrophotographic apparatus comprising:

an electrophotographic photosensitive member having a cylindrical support, a photosensitive layer provided on the outer periphery side of the cylindrical support, and an insert member inserted into the cylindrical support on its inner periphery side;

a charging device;

an exposure device;

a developing device; and a transfer device;

wherein:

the insert member has a first surface on which the insert is to be fitted in the cylindrical support and a second surface which is provided at least at one endmost portion of the insert member;

the first surface and the second surface have a difference in level between them;

the distance D2 between the second surface and the inner periphery of the cylindrical support is larger than distance D1 between the first surface and the inner periphery of the cylindrical support;

the line of intersection of a cross section S2 including points on the second surface and a rotating shaft of the cylindrical support and the line of intersection of the cross section S2 and the inner periphery of the cylindrical support are substantially parallel to each other;

the insert member is fastened to the cylindrical support on its inner periphery side, with an adhesive provided between the second surface and the inner periphery of the cylindrical support;

the difference D2 D1 between the distance D2, between the second surface and the inner periphery of the cylindrical support, and the distance D1, between the first surface and the inner periphery of the cylindrical support, is in the range of from 30 μm to 150 μm;

wherein a maximum length of the first surface of the insert member in the direction of the rotating shaft of the cylindrical support is from 80% to 98% with respect to the whole length of the insert member in the direction of the rotating shaft of the cylindrical support;

wherein the second surface extends over 95% or more of its whole periphery; and the adhesive is a cyanoacrylate-type adhesive.

7. An electrophotographic photosensitive member according to claim 1, wherein the difference D2−D1 between the distance D2, between the second surface and the inner periphery of the cylindrical support, and the distance D1, between the first surface and the inner periphery of the cylindrical support, is in the range of from more than 30 μm to 150 μm.

8. An electrophotographic apparatus according to claim 4, wherein the difference D2−D1 between the distance D2, between the second surface and the inner periphery of the cylindrical support, and the distance D1, between the first surface and the inner periphery of the cylindrical support, is in the range of from more than 30 μm to 150 μm.

9. An electrophotographic photosensitive member according to claim 5, wherein the difference D2−D1 between the distance D2, between the second surface and the inner periphery of the cylindrical support, and the distance D1, between the first surface and the inner periphery of the cylindrical support, is in the range of from more than 30 μm to 150 μm.

10. An electrophotographic apparatus according to claim 6, wherein the difference D2−D1 between the distance D2, between the second surface and the inner periphery of the cylindrical support, and the distance D1, between the first surface and the inner periphery of the cylindrical support, is in the range of from more than 30 μm to 150 μm.

* * * * *